US010160138B2

(12) United States Patent
Thoma et al.

(10) Patent No.: US 10,160,138 B2
(45) Date of Patent: Dec. 25, 2018

(54) ADMIXTURE PIECE AND HOUSING ELEMENT FOR A MIXING DEVICE

(75) Inventors: Adrian Thoma, Dübendorf (CH); Stefan Zehnder, Birmenstorf (CH)

(73) Assignee: SIKA TECHNOLOGY AG, Baar (CH)

( * ) Notice: Subject to any disclaimer, the term of this patent is extended or adjusted under 35 U.S.C. 154(b) by 1327 days.

(21) Appl. No.: 13/978,265

(22) PCT Filed: Jan. 12, 2012

(86) PCT No.: PCT/EP2012/050416
§ 371 (c)(1),
(2), (4) Date: Jul. 3, 2013

(87) PCT Pub. No.: WO2012/095480
PCT Pub. Date: Jul. 19, 2012

(65) Prior Publication Data
US 2013/0272083 A1 Oct. 17, 2013

(30) Foreign Application Priority Data
Jan. 12, 2011 (EP) ..... 11150748

(51) Int. Cl.
*B28C 5/00* (2006.01)
*B28C 5/02* (2006.01)
(Continued)

(52) U.S. Cl.
CPC ..... *B28C 5/026* (2013.01); *B01F 5/048* (2013.01); *E04F 21/08* (2013.01)

(58) Field of Classification Search
CPC ..... B28C 5/4231; B28C 5/026; B01F 5/048; E04F 21/08
(Continued)

(56) References Cited

U.S. PATENT DOCUMENTS 3,999,740 A * 12/1976 McCorvey ..... B29B 7/7457 366/138
5,529,284 A * 6/1996 Berger ..... F16L 15/001 251/149
(Continued)

FOREIGN PATENT DOCUMENTS

DE 40 29 982 A1 3/1992
EP 1 570 908 A1 9/2005
(Continued)

OTHER PUBLICATIONS

DE4029982.*
(Continued)

*Primary Examiner* — Anshu Bhatia
(74) *Attorney, Agent, or Firm* — Oliff PLC

(57) ABSTRACT

A tubular admixture piece for receiving in a mixing device for controlled metering in of an adjuvant into a pumpable mixture has at least one sealing element for producing an at least partially fluid-tight connection between the admixture piece and the mixing device wherein the at least one sealing element is designed as an axial seal with respect to a longitudinal axis of the tubular admixture piece. A housing element of a mixing device has at least a sealing support for axial sealing of the admixture piece, and is also configured to exert a force that acts on the admixture piece in the axial direction and/or longitudinal direction of the through-flow opening, such that the axial seal of an admixture piece received at least partially in the through-flow opening can be pressed against the sealing support by the force.

16 Claims, 3 Drawing Sheets

(51) Int. Cl.
*B01F 5/04* (2006.01)
*E04F 21/08* (2006.01)

(58) Field of Classification Search
USPC ..... 366/8, 16, 40; 277/592
See application file for complete search history.

(56) References Cited

U.S. PATENT DOCUMENTS

| | | | | |
|---|---|---|---|---|
| 6,435,515 | B1 * | 8/2002 | Galletti | F16J 15/002 366/331 |
| 2004/0201181 | A1 * | 10/2004 | Williamson | F02M 35/10078 277/592 |
| 2004/0228740 | A1 | 11/2004 | Matsumoto et al. | |
| 2005/0279596 | A1 | 12/2005 | Gassner et al. | |
| 2007/0196223 | A1 * | 8/2007 | Hogan | F04B 11/0075 417/500 |

FOREIGN PATENT DOCUMENTS

| | | | |
|---|---|---|---|
| JP | U-60-24359 | | 2/1985 |
| JP | S61-29861 | U | 2/1986 |
| JP | H05-248443 | A | 9/1993 |
| JP | H06-502342 | A | 3/1994 |
| JP | A-8-103699 | | 4/1996 |
| JP | 2001-002109 | A | 1/2001 |
| JP | 2004-270523 | A | 9/2004 |
| JP | 2006-514229 | A | 4/2006 |
| WO | 90/11877 | A1 | 10/1990 |
| WO | 92/04973 | A1 | 4/1992 |

OTHER PUBLICATIONS

DE4029982 Machine Translation.*
Mar. 29, 2016 Office Action issued in Japanese Patent Application No. 2013-548839.
Jun. 9, 2015 Office Action issued in Japanese Patent Application No. 2013-548839.
Nov. 17, 2015 Office Action issued in Mexican Patent Application No. MX/a/2013/008041.
Feb. 5, 2016 Office Action issued in Australian Patent Application No. 2012206572.
May 31, 2016 Office Action issued in Chilean Patent Application No. 2017-13.
May 3, 2012 International Search Report issued in International Application No. PCT/EP2012/050416.
May 31, 2016 Office Action issued in Mexican Patent Application No. MX/a/2013/008041.
Nov. 2, 2016 Office Action issued in Chilean Patent Application No. 2013-002017.
Feb. 12, 2018 Office Action issued in Canadian Patent Application No. 2,824,228.

* cited by examiner

ADMIXTURE PIECE AND HOUSING ELEMENT FOR A MIXING DEVICE

TECHNICAL FIELD

The invention relates to a tubular admixture piece for receiving in a mixing device for controlled metering of an additive into a pumpable mixture, particularly a pumpable hydraulic setting mixture, in particular a spray concrete composition, wherein the admixture piece comprises a mixing section extending through the admixture piece for conveying the pumpable mixture, and, in a wall of the admixture piece, at least one opening leading into the mixing section is introduced, for discharging the additive into the mixing section, and wherein, on the admixture piece, at least one sealing element is present for establishing an at least partially fluid-tight connection between the admixture piece and the mixing device.

The invention further relates to a housing element of a mixing device for the controlled injection of an additive into a pumpable mixture, particularly a pumpable hydraulic setting mixture, in particular a spray concrete composition, wherein the housing element comprises a through-flow opening for the pumpable mixture, wherein the through-flow opening is designed for receiving at least partially an admixture piece.

A further aspect of the invention relates to an apparatus set comprising an admixture piece and a housing element. In addition, the invention relates to the use of an admixture piece for controlled metering of an additive into a pumpable mixture.

PRIOR ART

The metering or admixing of small quantities of a substance, for example, of an additive, into a pumpable mixture is essential in many applications. However, thorough mixing is often difficult to achieve, particularly in the case of heterogeneous mixtures with solids contents. It is particularly difficult to meter in additives into hydraulic setting mixtures, which usually have a relatively high solids content of abrasively acting sand, gravel, and cement.

The admixing of additives during the processing of spray concrete is particularly challenging. Prior to the spraying, the spray concrete flows at high speed through a conveyance line with attached spraying nozzle. Necessary recipe components, such as, for example, water (in dry spray concrete), pressurized air, and additives (for example, solidification accelerators), are usually metered in only immediately before the spraying nozzle or at most approximately 2.5 m before. The spray concrete mixture that has now been completely prepared is subsequently projected under pressure onto the application site, and it compacts sufficiently in the process so that a completely compacted concrete structure forms substantially immediately. Accordingly, particularly efficient and robust mixing devices are needed for the processing of spray concrete.

Known mixing devices for processing spray concrete consist usually of a tubular admixture piece which is designed as a wearing part, and which is held replaceably in a special housing. Side inlets on the admixture piece here allow the metering of an additive into the mixture conveyed through the tubular admixture piece. Depending on the application, different admixture pieces are used here, which differ, for example, in regard to the number, size and geometry of the side inlets and/or in regard to the cross-sectional geometry of the conveyance line.

EP 1 570 908 A1 (Sika Technology AG) discloses, in that regard, for example, a nozzle for spraying concrete for the application of wet spray concrete or dry spray concrete with an integrated admixture piece for metering in of an additive. The admixture piece here has a plurality of side channels for introducing additives into the spray concrete. The integrated admixture piece of the nozzle for spraying concrete is provided to be received in a housing with a connection for the feed of the additive. For the introduction of the additive to take place in a controlled and steady manner through the side channels of the admixture piece, sealing is provided in the housing before and behind the side channels. For this purpose, circumferential ring-shaped grooves are provided in the nozzle for spraying concrete of EP 1 570 908, which are designed for receiving O rings. If the area of the admixture piece is moved into a housing with fitting cylindrical opening, the area located between the O rings is sealed with formation of a radial seal.

In other commercially available mixing devices, the O rings used for the sealing are arranged in correspondingly designed grooves in the housing of the mixing device.

However, known mixing devices can be operated reasonably satisfactorily only if the components (housing and admixture piece) are manufactured from a precision material, such as steel, for example. If the admixture piece is manufactured from plastic, for example, which is particularly advantageous for reasons pertaining to weight, the resulting tolerances are large. To ensure the tightness of the O rings in every case, the grooves for the O rings are usually designed to be oversized. However, as a result a radial tight fit is produced during the insertion of the admixture piece into the housing. This tight fit requires the exertion of a large force or the use of special tools for the insertion and the removal of the admixture piece, which makes the handling considerably more difficult.

DESCRIPTION OF THE INVENTION

Consequently, the problem of the invention is to provide an admixture piece belonging to the technical field mentioned at the start, which, at the time of the installation in or removal from a housing, can be handled more simply while nonetheless allowing a reliable sealing. An additional problem of the invention consists in providing a corresponding housing element of a mixing device.

With regard to the admixture piece, the problem is solved according to the invention by the characteristics of Claim 1. Accordingly, the at least one sealing element is designed in reference to a longitudinal axis of the tubular admixture piece as an axial seal.

The problem with regard to the housing element is solved accordingly by the characteristics of independent Claim 9, according to which at least one sealing support arranged on the housing element is present, for a seal element of the admixture piece, which is designed as an axial seal, and means are present for the exertion of a force acting in the axial direction and/or longitudinal direction of the through-flow opening onto the admixture piece, so that the axial seal of at least one admixture piece received at least partially in the through-flow opening can be pressed against the sealing support by the means for the exertion of the force.

Further aspects of the invention are the subject matter of further independent claims. Particularly preferred embodiments of the invention are the subject matter of the dependent claims.

The term "tubular admixture piece" denotes particularly a tubular element with an inlet and with an outlet, which are connected by a fluid conducting channel or a conveyance line. The fluid conducting channel or conveyance line here corresponds to the mixing section of the tubular admixture piece. Here, in the area of the mixing section, the mixing of the pumpable mixture with the additive takes place. The terms conveyance line and mixing section are accordingly used synonymously in the present context.

The cross sectional area of the fluid conducting channel can be designed to be constant or changing along the conveyance line. A shape of the cross sectional area can be selected as desired in accordance with the intended use, for example, circular, oval and/or polygonal. For reasons pertaining to fluid dynamics, a circular cross sectional area is preferable. In particular, the tubular admixture piece is a cylindrical pipe section, in particular one with a substantially circular cylindrical conveyance line. In the present context, the term cylindrical pipe section refers in particular to pipe sections that comprise, in the area of the lateral surface, projecting sealing elements, flanges and/or tapered pipe sections.

An inner diameter, particularly a minimum inner diameter, of the conveyance line is preferably at least 25 mm. A maximum value of the inner diameter of the conveyance line measures in particular at most approximately 100 mm. It is particularly preferable for the inner diameter of the conveyance line to be 32 mm, 38 mm, 50 mm, 60 mm, 65 mm or 85 mm. As a result, the admixture piece can be connected in the best possible manner to standardized components such as conveyance lines, conveyance tubes and/or nozzles for spraying concrete, for example. Moreover, in the case of such dimensions, an optimal conveyance of different conveyance quantities (cubic per min) of spray concrete compositions is ensured in particular. A total length of the admixture piece, measured in the axial direction, is advantageously 30-300 mm, and more preferably 50-150 mm.

The "longitudinal axis of the tubular admixture piece" corresponds particularly to the direction predetermined by the fluid conducting channel or the conveyance line, which also corresponds particularly to a conveyance direction of the pumpable mixture to be conveyed in the conveyance line. The term "axial direction" or in "the axial direction" in the present context stands particularly for the direction defined by the fluid conducting channel or by the conveyance line.

In the case of a cylindrical pipe section, the longitudinal axis corresponds substantially to the longitudinal axis and/or axis of symmetry of the conveyance line and/or of the tubular admixture piece.

The term "sealing element," in the present context, stands particularly for a shaped element made of plastic. The sealing element is designed here in such a manner that, as a result of being pressed with contact against a sealing surface on a part to be sealed off, a fluid-tight connection is achieved.

Moreover, the term "radial seal," in the present context, refers particularly to a seal in which the sealing element, for example, an O ring, extends substantially in the radial direction from a first sealing surface on a first body to a second sealing surface on a second body, and it seals off a radial intermediate space. Thus, during the installation, a radial seal is pre-pressed substantially by a force acting in the radial direction, in order to achieve the desired sealing effect.

In contrast, the term "axial seal" denotes particularly a sealing element which extends along a longitudinal axis and which seals off a gap between two axially spaced sealing surfaces. In order to achieve the desired sealing effect, an axial seal is pre-pressed during the installation in particular by a force acting in the axial direction.

In a radial seal, the through-flow direction of leakage thus extends particularly in the axial direction, whereas in an axial seal, depending on the angle of the spaced sealing surfaces with respect to the axis, the through-flow direction has at least one radial component.

As has been shown in practice, the admixture pieces according to the invention can be inserted in a simple manner into correspondingly designed mixing devices or housing elements and also removed again from them.

This is the case in particular because it is possible due to the axial seal according to the invention to completely omit radial seals on the admixture piece or in the mixing device. Thus, the admixture piece does not need to be exactly in agreement in regard to the diameter dimensions with the inner diameter of the outlet opening in the mixing device, as is the case in conventional admixture pieces. On the contrary, an outer diameter of the admixture pieces according to the invention can be selected to be clearly smaller than the inner diameter of the receiving opening in the mixing device, so that the admixture piece can be pushed with play into the receiving opening or removed therefrom. Manufacturing tolerances, which in general are considerably higher in the case of admixture pieces made of plastic than admixture pieces made of steel, are also largely unproblematic due to the solution according to the invention.

Nevertheless, the axial seal present according to the invention makes it possible to establish a fluid-tight connection between the admixture piece and the mixing device or in the receiving opening. For this purpose, it is sufficient, as described in further detail below, for the axial seal to be held stationary on the admixture piece, pushed by a force acting in the axial direction against a sealing surface in the mixing device. This represents a simple and nonetheless exceedingly effective sealing method.

It has also been shown that the admixture pieces according to the invention are particularly advantageous for metering of an additive into a pumpable hydraulic setting mixture, in particular into a spray concrete composition. The spray concrete composition can be in particular a wet, earth-moist or dry spray concrete composition.

Thus, it should be noted that the admixture piece according to the invention can be handled more easily during the installation in or removal from a housing, and reliable sealing is nonetheless made possible.

In principle it is possible to provide additionally one or more radial seals on the admixture piece, besides the at least one axial seal according to the invention. For special applications, this can be appropriate under some circumstances. However, in this case the advantages according to the invention are at least partially lost.

It is particularly preferable to design the axial seal as a ring-shaped sealing lip which, particularly in one section, has a preferably continuous, wedge-shaped converging cross section. In particular, an area of a wedge tip of the sealing lip is designed here as a sealing edge. With such sealing lips, mechanically stable and tight axial seals can be produced in the present context. The area of the wedge tip here forms a defined sealing edge having a smaller support surface. Under the action of a force acting in the axial direction, a high pressure is thus generated in the area of the support surface, which produces a good sealing effect. The broader area of the wedge tip located behind the area of the wedge tip at the same time ensures high mechanical stability of the sealing lip or of the sealing element.

However, in principle, the axial seal can also be, for example, in the form of an O ring or of a flat seal, having a rectangular or conical cross section, for example.

In particular, a wedge angle of the sealing lip measures 10°-80°, preferably 20°-70°, and particularly preferably 25°-35°. The wedge angle in this context denotes particularly the angle between the two wedge surfaces of the sealing lip converging at the wedge tip. Such acute wedge angles have been shown to be particularly suitable with a view to an optimal sealing effect and stability.

However, in principle, wedge angles of less than 10° or more than 80° are also possible.

Moreover, it has been shown that the sealing lip in the area of the wedge tip particularly preferably comprises a convex curved edge surface as a sealing edge. As a result, the support surface of the sealing edge on a surface can be further reduced, since the support surface in this case approximates a support line. At the same time, with a convex curved edge surface, the mechanical stability of the sealing lip is improved in comparison to a sharp-edged wedge tip, since the risk of damage to the edge, for example, by tearing of the sealing lip in the thin edge area, is reduced.

However, it is not obligatory to use convex curved edge surfaces. In principle, the sealing lip in the area of the wedge tip can also be formed, for example, with a sharp edge, or with a flattened sealing edge.

According to a particularly preferred embodiment, the axial seal is arranged on a front side of a flange present on the admixture piece. The flange here functions as a supporting element for the axial seal. This makes it simple to arrange the axial seal on the admixture piece. It is preferable for the flange to be flush in the axial direction with the tubular admixture piece.

In principle it is also conceivable, however, to arrange the axial seal, for example, on a front side of the wall of the tubular admixture piece and/or on a front side of a step-shaped tapering and/or a radially pinched in tapering of the tubular admixture piece.

It is preferable that the axial seal arranged on the front side of the flange is arranged so that it is at least partially spaced, preferably completely spaced, from the wall of the admixture piece, so that a groove is present between the axial seal and the wall. In addition, the groove has in particular a concave curved delimitation surface. Due to the spacing of the axial seal, the sealing lip can be pressed better against the given seal support in the mixing device. In particular, it is possible in this case that the area of the wedge tip remains movable to a limited extent in the radial direction at the time of pressing against the sealing support in the mixing device, and thus it can be pressed better against the sealing support.

This is advantageous, for example, in combination with sealing supports designed to converge conically in the mixing device, which at the same time allow automatic centering of the sealing lips.

A concave curved delimitation surface of the groove moreover has the advantage that fewer or no edges are present in the groove area, in which material could get stuck. As a result, when using the admixture piece in a mixing device, a potential accumulation of material and the associated risk of clogging are reduced. In addition, grooves of such a design are easier to clean.

In principle, the axial seal can also be arranged adjacently on the wall of the admixture piece. Similarly, it is possible to provide a groove with non-concave curved delimitation surface. However, in these cases, the above-mentioned advantages are eliminated at least partially.

With the exception of a reinforcing element, if present, it is particularly preferable according to an additional preferred embodiment to manufacture the admixture piece and/or the axial seal from a plastic, particularly preferably from a plastic having a Shore A hardness of 50-120. It is particularly preferable for the plastic to have a Shore A hardness of 70-95. Suitable plastics include polyurethane, for example. Such plastics have good mechanical stability and they exhibit optimal deformability upon applying an axial force, so that a good sealing effect is obtained. This has been shown to be the case particularly when using the admixture piece under relatively harsh connections in association with hydraulic setting mixtures, in particular with wet, earth-moist or dry spray concrete compositions.

It is preferable for the at least one sealing element and/or the axial seal to be connected by substance bonding to the admixture piece. As a result, optimal positioning and sealing effect are ensured. In addition, there is no risk of losing the sealing element during the installation or removal of the admixture piece.

In particular, the at least one sealing element and/or the axial seal is an integral component of the admixture piece. This means in particular that the admixture piece in the area of the at least one sealing element can be designed as an axial seal. In this case, the at least one sealing element and/or the axial seal consists, at least in the area of the at least one sealing element in particular, of the same material as the admixture piece. The admixture piece as well as the at least one sealing element or the axial seal in this case form a unit connected by substance bonding. Particularly advantageously, the admixture piece is manufactured at least in the area of the at least one sealing element from a plastic, particularly preferably from a plastic having a Shore A hardness of 50-120. Plastics having a Shore A hardness of 70-95 are even more advantageous. It is most preferable to design the admixture piece so that it is formed entirely by a single piece, with the exception of a reinforcing element, if any. This means in particular that the admixture piece together with the axial seal and any other elements that may be used, such as the at least one flange, for example, form a unit that is connected by substance bonding. According to an advantageous variant, the admixture piece consists of a single-piece cast body and optionally of a reinforcing element embedded at least partially therein. The cast body here consists particularly of a plastic, and particularly preferably of a plastic having a Shore A hardness of 50-120. Plastics having a Shore A hardness of 70-95 are even more advantageous. As a result, particularly stable admixture pieces can be produced economically. In particular, an admixture piece consisting of a single-piece cast body can be manufactured in a single work step without expensive finishing. If a reinforcing element is used, particularly a ring-shaped reinforcing element, it is embedded here advantageously at least partially, in particular completely, in the cast body, so that said reinforcing element does not come in contact with the media or the pumpable mixture. Such a reinforcing element can be embedded directly in the cast body during the casting of the latter.

In principle, the admixture piece can also consist of several individual parts connected by a nonpositive and/or positive connection.

In a further advantageous embodiment, another sealing element is present additionally on the admixture piece, which said sealing element is spaced in the direction of the longitudinal axis of the tubular admixture piece away from at least one sealing element. The additional sealing element is designed in particular as an additional axial seal. It is most particularly preferable to design the additional sealing element also as a ring-shaped sealing lip which has a wedge-shaped cross section and is designed as a sealing edge comprising particularly preferably a convex curved edge surface as sealing edge, in the area of the wedge tip. A wedge angle of the sealing lip of the additional sealing element measures advantageously in particular 10°-80°, preferably 20°-70°, and particularly preferably 25°-35°.

In a particularly preferred embodiment, the additional sealing element is arranged on a front side of a step-shaped tapering and/or of a radially pinched in tapering of the tubular admixture piece. It is preferable that the axial seal arranged on the front side of the pinched in tapering is arranged so that it is at least partially, preferably completely, spaced away from the wall of the admixture piece, in such manner that, between the axial seal and the wall, a groove is present, which advantageously has a concave curved delimitation surface.

In principle, the second sealing element can, however, also be applied on an additional projecting flange or on a front side of the wall of the tubular admixture piece. In principle, it is additionally possible to provide, instead of or in addition to the sealing lip, a differently designed sealing element which, for example, does not have a wedge-shaped cross section, such as, for example, an O ring or a flat seal having a rectangular cross section.

In the case of two mutually spaced sealing elements, the opening leading into the conveyance line can be arranged, for example, between the at least one sealing element and the additional sealing element. In this case, the area of the opening can be completely sealed in a housing by the two sealing elements, in particular in the form of axial seals. This is advantageous with a view to a controlled metering of an additive into a pumpable mixture, particularly a pumpable hydraulic setting mixture, in particular a wet, earth-moist or dry spray concrete composition.

It is particularly advantageous to use a maximum extent, in particular a maximum outer diameter, of the additional sealing element in a direction perpendicular to the longitudinal axis and/or in a radial direction of the tubular admixture piece, which is less than a maximum extent, in particular a maximum outer diameter, of the at least one sealing element. Such a design makes it possible to push the tubular admixture piece with the additional sealing element substantially without any force exertion forward in the axial direction into a correspondingly designed opening of a housing of a mixing device until both the at least one sealing element and also the additional sealing element come to bear against a sealing support provided for this purpose. Removal of the tubular admixture piece can then occur in the opposite direction also without exerting force. In addition, in this embodiment, it is ensured that the admixture piece automatically comes to lie in an unequivocally defined position. As a result, accidental installation of the admixture piece in an incorrect direction is prevented.

However, it is also conceivable in principle to design the two sealing elements substantially with equal dimensions, and to apply them, for example, on the two end-side front sides of the wall of the tubular admixture piece. It is also possible to provide the two sealing elements, for example, with substantially equal maximum extents, and to provide a special housing with an at least partially disassemblable opening for the installation of the admixture piece. However, this eliminates the above-mentioned advantages at least partially.

According to an additional embodiment, the tubular admixture piece preferably comprises a structural reinforcing element. The reinforcing element consists advantageously of a material having a lower resilience than a material of the fluid conducting channel or of the mixing section. In principle, it is also possible that several spaced and/or mutually connected reinforcing elements are present.

The reinforcing element can be manufactured, for example, from plastic, metal and/or from a composite material. By means of the reinforcing element, the mechanical stability can be increased in a targeted manner in partial areas, particularly in the radial direction, of the tubular admixture piece, wherein the required axial resilience is preserved.

It is particularly preferable for the reinforcing element to be manufactured from a metal, particularly steel. As a result, optimal reinforcement of the tubular admixture piece is achieved.

In a particularly advantageous embodiment, the reinforcing element is designed as a ring-shaped and/or hollow cylindrical element, particularly as a metal ring. Thus, the reinforcing element can be arranged, for example, in a simple manner in the area of the fluid conducting channel, and it has available here an optimal supporting action in the radial direction. In principle, it is however also possible to provide differently designed reinforcing elements. They can be, for example, fibers, grids, or meshworks made of fibers. Thus, reinforcement of the tubular admixture piece in the radial direction can also be achieved, without losing the required flexibility in the axial direction.

A length of the reinforcing element, particularly of a metal ring, in the axial direction of the admixture piece is advantageously 5-50%, and particularly 10-30% of the entire length of the admixture piece. A thickness of the reinforcing element, particularly of a metal ring, is advantageously smaller than the thickness of the wall of the tubular admixture piece in the area of the reinforcing element. As a result, an optimal reinforcement action with compact dimensions and preservation of the required resilience in the axial direction is achieved. In addition, the reinforcing element can thus be completely embedded in the wall of the admixture piece without protruding.

It is particularly preferable for the reinforcing element to be embedded at least partially, preferably completely, in a wall of the tubular admixture piece or in the fluid conducting channel. As a result, one achieves in particular that the admixture piece cannot be deformed radially under the usual conditions, and thus the function of the sealing lips in broad areas is preserved. In addition it is advantageous if the reinforcing element does not protrude in the interior of the tubular admixture piece. As a result, no protrusions are formed by the reinforcing element, which, among other effects, could affect the flow behavior of the pumpable mixture in the fluid conducting channel.

In particular, the reinforcing element is arranged in the area of the fluid conducting channel or of the mixing section. To the extent that the admixture piece comprises two sealing elements, the reinforcing element is advantageously arranged in an area between the two sealing elements.

However, in principle the reinforcing element can also be present in other areas.

Below, a discussion is provided of the housing element according to the invention of a mixing device for the controlled injection of an additive into a pumpable mixture, particularly into a pumpable hydraulic setting mixture, in particular a spray concrete composition. The housing element comprises a base body with a through-flow opening, wherein the through-flow opening is designed for receiving at least partially an admixture piece as described above. The housing element is characterized in particular in that at least one sealing support arranged on the housing element (200) is present for a sealing element of the admixture piece, element which is designed as an axial seal, and in that means are present for exerting a force acting in the axial direction and/or longitudinal direction of the through-flow opening onto the admixture piece, so that the axial seal of an admixture piece which is received at least partially in the through-flow opening can be pushed against the sealing support by the means for the exertion of the force. In particular, the housing element in addition comprises a connection for feeding the additive into the through-flow opening.

The through-flow opening of the housing element is designed, particularly in at least some sections, to be substantially complementary to the admixture piece according to the invention. Moreover, the admixture piece can be received in particular coaxially in the through-flow opening of the housing element.

Due to the working together of the sealing support and of the means for the application of the force, handling during installation and removal of a tubular admixture piece as described above is substantially simplified and at the same time reliable sealing is still ensured. In particular, jamming of the sealing elements of the tubular admixture piece in the housing element, as occurs in the conventional system, is effectively prevented.

The means for application of a force acting in the axial direction on the admixture piece can in principle be selected in accordance with the requirements. For this purpose, several suitable technical devices are available to the person skilled in the art. The device can be, for example, a knee lever mechanism arranged on the base body or housing element. The tubular admixture piece present in the housing element and partially protruding from the opening can in this case be encompassed, for example, by one or more clamps arranged on the knee lever mechanism, and pushed, at the time of the tensioning of the knee lever mechanism, in the axial direction into the opening. It is also conceivable to provide a spring tensioning mechanism in which one or more pretensioned springs attached on the housing element push the tubular admixture piece in the axial direction into the opening of the housing element. Bayonet closure connection techniques are also conceivable.

It is particularly preferable to provide a union nut which can be screwed onto the base body as the means for exerting a force onto the admixture piece. For this purpose, the base body preferably comprises, in the area of an external side, a screw thread, in particular an outer thread.

The sealing support in the base body and the admixture piece are dimensioned here in such a manner that the admixture piece, when it bears against the sealing support, protrudes partially from the outlet opening of the base body, so that, in particular, the end of the admixture piece that protrudes out of the through-flow opening can be encompassed by the union nut.

The union nut comprises, in particular, a first hollow cylindrical end with a screw thread extending in the direction of the longitudinal axis, in particular with an inner thread. At the other end of the union nut, a circular opening is advantageously present which is tapered across from the first end. A diameter of the tapered opening is here advantageously at least as large as, and preferably larger than, the inner diameter of the conveyance line of the tubular admixture piece and and/or at the same time less than a maximum dimension, particularly an outer dimension, of the tubular admixture piece on a front-side end. As a result, the union nut can comprise the tubular admixture piece on the front side and, at the same time, an optimal passage remains for the mixture to be pumped through the mixing device.

Such a design, in this case, makes it possible to push the tubular admixture piece present in the housing element and partially protruding from the opening, in a simple and reliable manner by means of a screw motion of the union nut, into the opening of the housing element. As a result, the at least one sealing element or the axial seal of the admixture piece is pushed against the sealing support in the base body.

The use of a union nut as a means for the exertion of a force acting in the axial direction onto the admixture piece additionally makes it possible to connect the mixing device in a simple manner to other components. Thus, the union nut can also encompass, for example, a pipeline, a tube line and/or a nozzle for spraying concrete with an attachment flange arranged on the inlet side, and connect them in a fluid-tight manner to the mixing device. Due to the screw connection by means of the union nut, pipelines, tube lines and/or nozzles for spraying concrete with different flange thicknesses can be used here, wherein the thickness of the attachment flange can be compensated for in broad ranges.

It is advantageous to design the at least one sealing support of the base body as a lateral surface of a truncated cone and/or as a conically converging surface. The lateral surface of a truncated cone and/or the conically converging surface is/are here in particular rotationally symmetrical with respect to the longitudinal axis of the base body. An opening angle of the lateral surface of a truncated cone and/or of the conically converging surface measures advantageously 70-270°, or a half opening angle of 35-135°, measured relative to the longitudinal axis or the axis of the conveyance direction. A lateral surface of a truncated cone, which is configured as an external cone surface, advantageously has an opening angle of 180-220° or a half opening angle of 90-110° (measured from the longitudinal axis or the axis of the conveyance direction). A lateral surface of a truncated cone that is configured as an inner cone surface has in particular an opening angle of 80-100° or a half opening angle of 40-50° (measured from the longitudinal axis or the axis of the conveyance direction). If there is both an outer cone surface and an inner cone surface, a ratio of the opening angle of the outer cone surface to the opening angle of the inner cone surface is advantageously in the range of 1.8-2.75. As has been shown, this is facilitated by the centering of the axial seal of the admixture piece in the base body, which improves the sealing overall.

This is particularly advantageous in combination with an axial seal in the form of a sealing lip having a wedge-shaped cross section, which is preferably in addition spaced at least partially, particularly preferably completely, away from the wall of the admixture piece. When the wedge tip area of the sealing lip is pressed against the sealing support or the lateral surface of a truncated cone in the mixing device, the sealing lip can move to a limited extent in the radial direction, and thus be pressed even better against the sealing surface. As a result, the sealing in particular can be further improved.

However, in principle, a flat sealing surface can also be provided, which is located in particular in a plane that is perpendicular to a designated insertion direction of the tubular admixture piece and/or perpendicular to the longitudinal axis of the admixture piece inserted into the base body.

According to an additional preferred embodiment, an additional sealing support is present, which is arranged in the base body, for an additional sealing element present on the admixture piece and designed as an axial seal.

Corresponding admixture pieces having at least two sealing elements in the form of axial seals can thus be introduced into and removed from the receiving portion in a simple manner, wherein a high sealing effect is achieved at the same time. An area of the opening, which is present on the admixture piece, for introducing the additive into the conveyance line, can thus be sealed off on both sides in the housing element. With a view to controlled metering of an additive into a pumpable mixture, in particular into a pumpable hydraulic setting mixture, this is advantageous, particularly in a wet, earth-moist or dry spray concrete composition.

In addition to or instead of the additional sealing support, it is also possible to provide, for example, a radial seal integrated in the base body, for example, an O ring. However, in this case, the handling is made more difficult under some circumstances.

It is preferable to use a minimum diameter of the at least one sealing support which is greater than a minimum diameter of the additional sealing support. Thus, the receiving of an admixture piece as described above with two axial seals of different sizes is made possible. However, for differently designed admixture pieces, the sealing supports can also have approximately equal outer diameters, for example.

Here, it is preferable to design the at least one sealing support as an inner cone surface and/or the additional sealing support as an outer cone surface. If the admixture piece present in the housing between the two axial seals is subjected to pressure from the outside, a radial force directed outward and/or inward acts on the axial seals. Owing to the design of the two sealing surfaces, an associated moving away of the axial seals in the radial direction is effectively reduced, or the sealing effect of the axial seals is additionally increased owing to the additional compression forces in the radial direction.

In principle, one can consider using metals, plastics or composite materials with or without fiber reinforcement, as material for the housing element and/or the base body.

As metal, stainless steel and/or aluminum is/are suitable, for example. However, it is particularly advantageous for the housing element to be made from a plastic, in particular from polyoxymethylene copolymer, hereafter referred to as POM-C. POM-C denotes in particular a polymer, available commercially from various suppliers, based on a structural unit of formula $—[(CH_2—O)_n—(CH_2—CH_2—O—)_m]$. As a result, the weight of the housing element can be kept low, and in addition high mechanical and chemical stability is ensured, which is advantageous particularly in connection with pumpable hydraulic setting mixtures, in particular with wet, earth-moist or dry spray concrete compositions. Housing elements made of plastic can be manufactured relatively cost effectively, for example, by casting, compared to metals or composite materials.

In the case of a housing element having a base body and a union nut as the means for exerting a force acting in the axial direction of the admixture piece, according to a particularly preferred embodiment, the base body and also the union nut are each manufactured in the form of a single piece from a plastic, in particular POM-C.

The above described tubular admixture piece is made available advantageously together with the also above-described housing element as an apparatus set. The spacing of the two sealing elements on the admixture piece in the axial direction corresponds here in particular substantially to the spacing of the two sealing supports on the housing element. The through-flow opening in the housing element is here designed in particular in such a manner that the admixture piece can be received at least partially in the through-flow opening.

Additional advantageous embodiments and combinations of features of the invention result from the following detailed description and the totality of the claims.

BRIEF DESCRIPTION OF THE DRAWINGS

In the drawings which are used to explain the embodiment examples.

Identical parts basically bear identical reference numerals in the figures.

Ways To Carry Out The Invention

Admixture Piece

Figure 1:
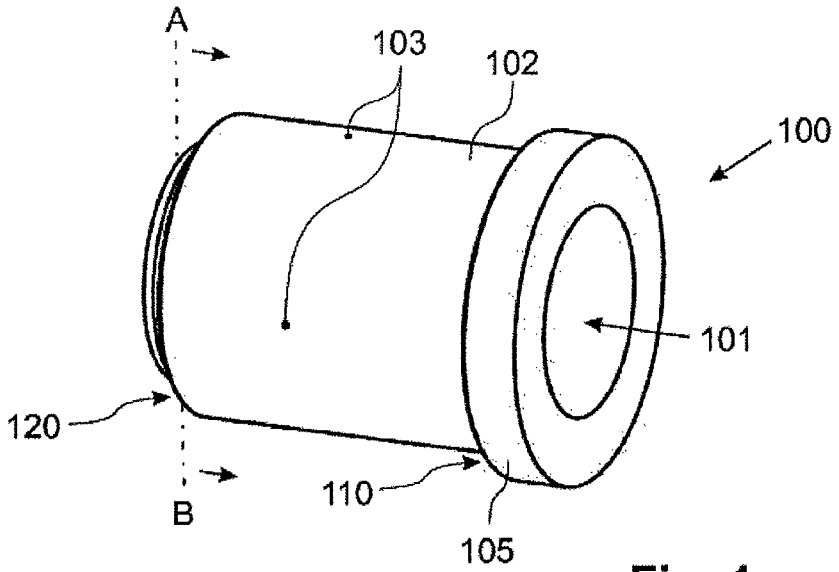
FIG. 1 shows a hollow cylindrical admixture piece with two sealing lips designed as axial seals in a perspective view.
Figure 2:
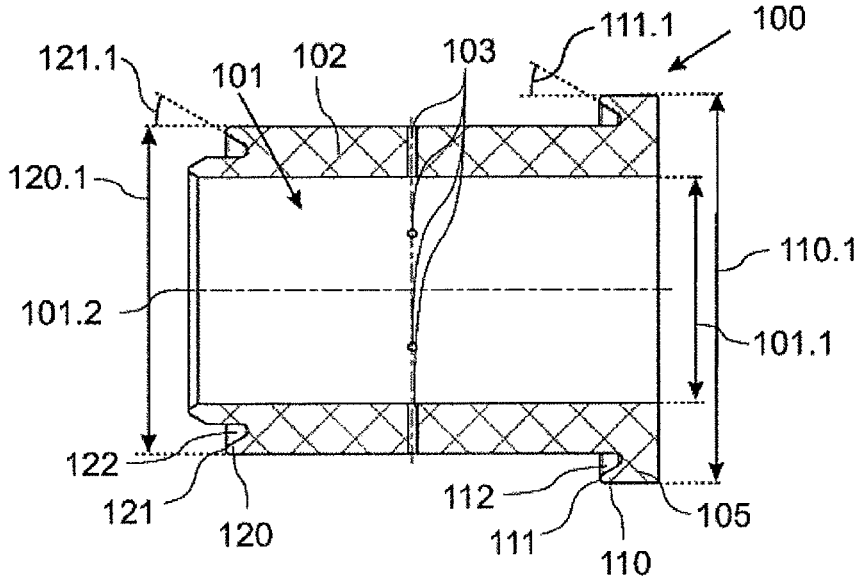
FIG. 2 shows a longitudinal section along line A-B through the admixture piece of FIG. 1.

In FIGS. 1 and 2, a tubular admixture piece 100 according to the invention is represented. The admixture piece 100 comprises a hollow cylindrical base body 102 with a circular cylindrical through-flow passage 101 extending along the longitudinal axis 101.2, which extends completely through the base body 102, and is used as mixing section or conveyance line for a pumpable mixture.

At one end, on the base body 102, a circumferential flange 105 is arranged. On the front-side surface of the flange 105, which faces the other end of the base body 102, a ring-shaped circumferential first sealing lip 110 designed so it is rotationally symmetrical with respect to the longitudinal axis 101.2 is arranged as a sealing element. The first sealing lip 110 is designed as an axial seal, and it has a wedge-shaped tapering cross section in a direction away from the front side of the flange 105. A wedge angle 111.1 of the first sealing lip 110 is, for example, approximately 30°. In the area of the outer circumferential surface, the sealing lip transitions seamlessly into the outer lateral surface of the flange 105.

An area of the free end 111 of the first sealing lip 110 or an area of the wedge tip is convexly curved, and forms a sealing edge of the sealing lip 110. In addition, in the radial direction, the sealing lip 110 is spaced away from the base body 102, so that a first circumferential groove 112 with a concavely curved delimitation surface is present between the wall of the base body 102 and the sealing lip 110.

In the area of the other end, the tubular admixture piece 100 has a step-shaped tapering or a radially pinched in tapering, on which an additional sealing element in the form of an additional circumferential sealing lip 120 is arranged. Like the first sealing lip 110, the second sealing lip 120 is also designed as an axial seal, it has a wedge-shaped tapering cross section, and it is rotationally symmetrical with respect to the longitudinal axis 101.2. With the exception of the reduced diameter in the radial direction, the additional sealing lip 120 is designed and oriented substantially the same as the first sealing lip 110. Accordingly, the second sealing lip 120 also has a wedge angle 121.1 of for example, approximately 30°, and an area of the free end 121 of the additional sealing lip 120 forms a convexly curved sealing edge. Moreover, the additional sealing lip 120 is spaced in the radial direction away from the wall of the base body 102, so that an additional circumferential groove 121 with a concavely curved delimitation is present between the wall of the base body 102 and the additional sealing lip 120. Here, the additional sealing lip 120 transitions seamlessly into the wall of the hollow cylindrical base body 102.

In addition, approximately in the middle between the two ends of the tubular admixture piece 100 and between the two sealing lips 110, 120, for example, six evenly spaced openings 103 leading in the radial direction into the circular cylindrical through-flow 101 are introduced into the wall of the hollow cylindrical base body 102. Said openings are used to introduce an additive into the circular cylindrical through-flow passage 101 provided as a mixing section. For example, it is also possible to provide 4 or 8 openings, which can also be at an angle with respect to the longitudinal axis.

A total length of the admixture piece 100, measured along the longitudinal axis 101.2, measures, for example, approximately 125 mm. An outer diameter 110.1 of the first sealing lip 110, measured in a direction perpendicular to the longitudinal axis 101.2 of the tubular admixture piece 100, measures, for example, approximately 100 mm, whereas an outer diameter 120.1 of the additional sealing lip 120 is, for example, approximately 87 mm. Thus, the outer diameter 120.1 of the additional sealing element is approximately 13% smaller than the outer diameter of the first sealing element. An inner diameter 101.1 of the admixture piece 100 is approximately 60 mm, for example.

The tubular admixture piece 100 is manufactured in particular entirely in the form of a single piece of plastic. An example of a suitable plastic is polyurethane having a Shore A hardness of approximately 50-120, for example, Shore A 75 or Shore A 90.

Housing Element

Figure 3:
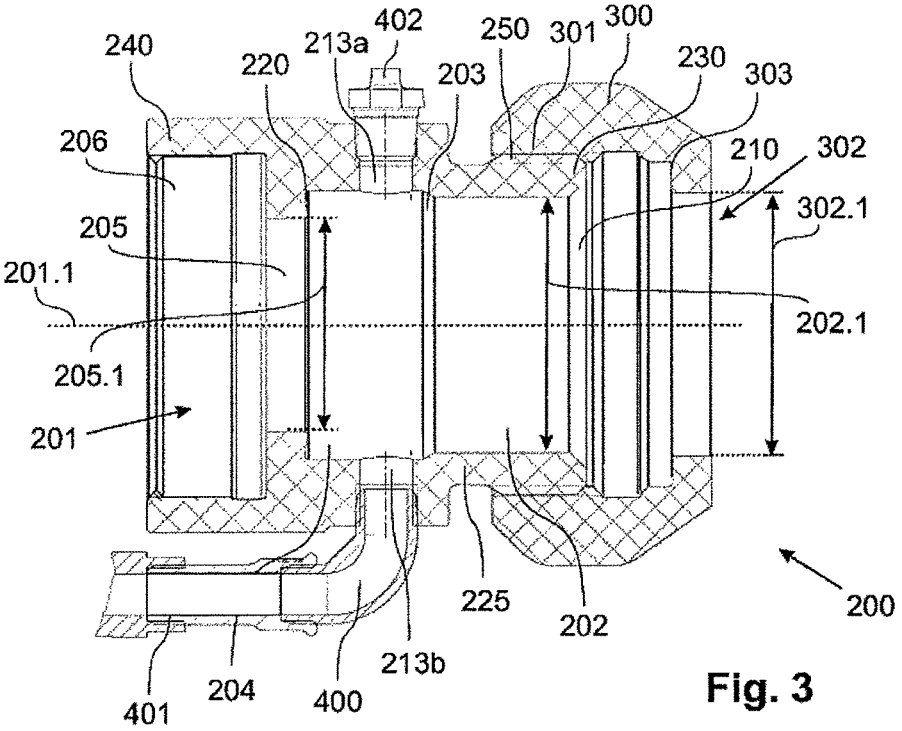
FIG. 3 shows a housing element with two truncated cone surfaces as sealing supports and a union nut as means for the exertion of a force acting in the axial direction and/or longitudinal direction of the admixture piece.

FIG. 3 shows a longitudinal section through a housing element 200 according to the invention, which comprises a tubular base body 225 with a central through-flow opening 201. The through-flow opening 201 here extends from a first end 230 to a second end 240 along a longitudinal center axis 201.1 completely through the base body 225. The through-flow opening 201 is here divided into several areas with different inner diameters, wherein all the areas are designed to be rotationally symmetrical with respect to the longitudinal center axis 201.1.

From the first end 230 of the base body 225 on, the through-flow opening 201 tapers conically. In other words, the section beginning at the first end 230 of the through-flow opening 201 is designed as a lateral surface of a truncated cone or inner cone surface 210. The inner cone surface 210 is used here as a sealing support for an axial seal of an admixture piece received in the base body 225. This is, for example, an admixture piece 100 as shown in FIGS. 1-2. An opening angle of the inner cone surface 210 measures, for example, approximately 90° (measured 45° from the longitudinal center axis).

The inner cone surface 210 is followed by a first hollow cylindrical section 202 with constant inner diameter, which transitions via a conical intermediate area 203 into a second hollow cylindrical section 204 with increased inner diameter.

The second hollow cylindrical section 204 subsequently leads into a third hollow cylindrical section 205. The transition between the second and the third hollow cylindrical sections is here designed step-shaped as a lateral surface of a truncated cone or outer cone surface 220, which is used as an additional sealing support for an additional axial seal of an admixture piece received in the base body 225. An opening angle of the outer cone surface 220 measures, for example, approximately 200° (measured 100° from the longitudinal axis).

The third hollow cylindrical section 205 finally transitions in a step-shaped manner into a connection area 206 with an enlarged diameter. The connection area 206 is designed, for example, for the connection of a conveyance line or of a conveyance tube.

In addition, two radial bores 213*a*, 213*b* lead into the area of the second hollow cylindrical section 204, from diametrically opposite directions, as feed lines for introducing an additive into the through-flow opening 201. One bore 213*a* is closed, for example, by means of a closure cap 402, while a tube line or a pipe 401 is connected to the other bore 213*b* via a curved connection piece 400. Depending on the application, it is also possible for the two bores 213*a*, 213*b* to be provided with a connection piece 400.

An inner diameter 202.1 of the first hollow cylindrical section 202, which corresponds to a minimum diameter of the inner cone surface 210, is here greater than an inner diameter 205.1 of the third hollow cylindrical section 205, which corresponds to the minimum diameter of the outer cone surface 220. In other words, the minimum diameter of the additional sealing support (outer cone surface 220) is thus smaller than the minimum diameter of the first sealing support (inner cone surface 210) in the housing element 200.

Moreover, in the area of the first end 230, an outer thread 250 is provided in the base body 225. A union nut 300 is screwed onto the outer thread 250.

The union nut 300 has a first hollow cylindrical end with an inner thread 301 extending in the direction of the longitudinal axis. At the other end of the union nut, a circular cylindrical opening 302 is present, which tapers in a step-shaped manner across from the first end. As a result, in the interior of the union nut 300, a plate-shaped front surface 303 adjacent to the opening 302 is present, which is provided as a contact surface for an admixture piece and/or additional tubular elements. A diameter 302.1 of the opening is here smaller than a diameter of the inner thread 301.

By means of a screwing motion of the union nut 300 on the outer thread 250 of the base body 225, the union nut can be moved in the axial direction or in the direction of the longitudinal axis 201.1 toward the base body 225. An element arranged behind the opening 302 of the union nut 300 and bearing against the front surface 303, for example, an admixture piece 100 as shown in FIGS. 1-2, can thus be pressed against the housing element. As a result, the union nut can be used as a means for exerting a force acting in the axial direction or in the direction of the longitudinal axis 201.1.

The base body 225 and the union nut 300 are advantageously manufactured from plastic, each forming a single piece. As plastic, POM-C for example is suitable, Apparatus Set The admixture piece 100 and the housing element 200 together form an apparatus set. A spacing of the two sealing edges 111, 121 on the admixture piece 100 here corresponds substantially to a spacing of the two sealing supports 210, 220 on the housing element 200. An outer diameter of the admixture piece 100, between the two sealing lips 110, 120, is moreover smaller than the inner diameter in the area of the first two hollow cylindrical sections 202, 204 and the conical intermediate area 203. As a result, the admixture piece 100 can be received in the radial direction with play in the through-flow opening 201.

Figure 4:
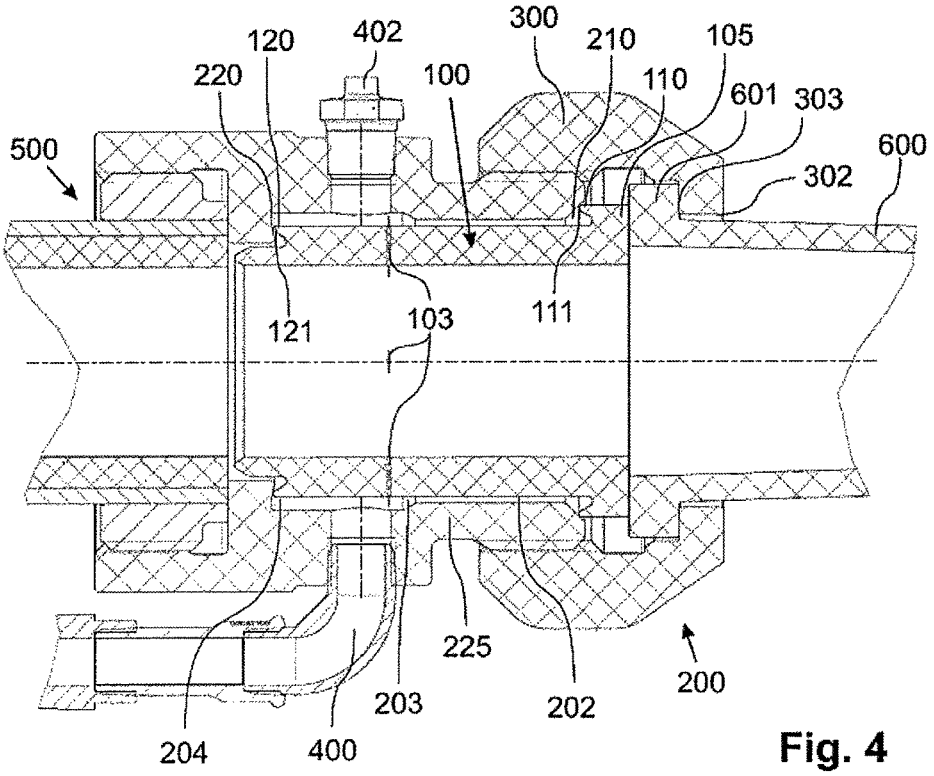
FIG. 4 shows the housing element of FIG. 3, fitted with the admixture piece of FIGS. 1-2, which is connected additionally to a conveyance tube and to a nozzle for spraying concrete.

FIG. 4 shows an arrangement comprising the housing element 200 of FIG. 3 with the admixture piece 100 of FIGS. 1-2 received therein, in a longitudinal cross section. This arrangement corresponds to a mixing device for the controlled metering of an additive into a pumpable hydraulic setting mixture, in particular a wet, earth-moist or dry spray concrete composition.

The first sealing lip 110 of the admixture piece 100 bears with its free end 111 or with the sealing edge against the inner cone surface 210 of the base body 225. Similarly, the additional sealing lip 120 of the admixture piece 100 bears with its free end 121 or with the sealing edge against the outer cone surface 220 of the base body 225. Here, the area of the flange 105 projects in the axial direction beyond the first end 230 of the base body 225 into the inner area of the union nut 300. In addition, an inlet-side flange 601 of a nozzle 600 for spraying concrete is arranged between the flange-side end of the admixture piece 100 and the front surface 303 of the union nut 300. The outer diameter of the inlet-side flange 601 of the nozzle 600 for spraying concrete is here greater than the diameter of the opening 302 of the union nut 300. By tightening the union nut 300, the inlet-side flange 601 of the nozzle 600 for spraying concrete is pushed against the flange-side end of the admixture piece 100, as a result of which the two sealing lips 110, 120 are pressed in the axial direction against the respective support surfaces 210, 220. As a result, fluid-tight connections are present between the sealing lips 110, 120 and the associated support surfaces 210, 220. A fluid which, through the connection piece 400, reaches the first two hollow cylindrical sections 202, 204 and the conical intermediate area 203, for example, an additive for a spray concrete composition, can thus escape only through the openings 103 in the admixture piece 100, as a result of which a controlled admixing of the fluid into the mixing section 101 of the admixture piece 100 or into a pumpable mixture conveyed therein is made possible.

In the connection area 206 of the housing element 200, an open end of a conveyance pipe or of a conveyance tube 500, provided with a coupling device, is additionally connected in a known manner. Through the conveyance pipe or the conveyance tube 500, a pumpable mixture, for example, a spray concrete composition, can be conveyed into the admixture piece 100. An inner diameter of the conveyance pipe or of the conveyance tube 500 corresponds substantially to the inner diameter 101.1 of the tubular admixture piece 100.

Figure 5:
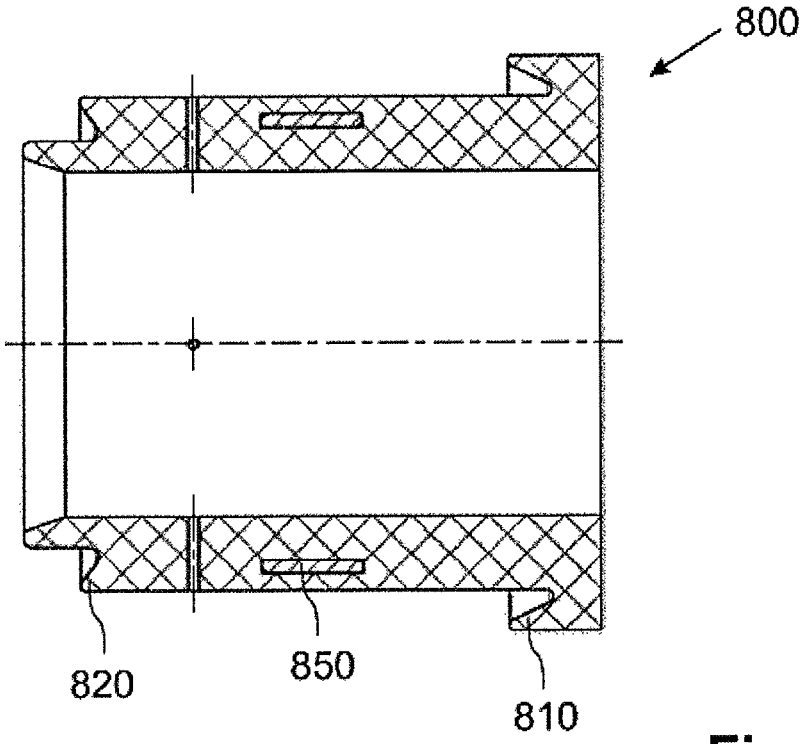
FIG. 5 shows a variant of the hollow cylindrical admixture piece of FIG. 1 with a cast-in, ring-shaped reinforcing element in the area between the two sealing lips in a longitudinal section.

FIG. 5 shows an additional tubular admixture piece 800 according to the invention in cross section. This piece is substantially identical in design to the admixture piece 100 of FIGS. 1 and 2, but, in addition, in an area between the two sealing elements 810, 820, it comprises a reinforcing element 850. The reinforcing element 850 is designed as a steel ring and it is completely embedded or cast in the wall of the tubular admixture piece 800. A length of the reinforcing element in the axial direction measures, for example, approximately 17% of the total length of the admixture piece 800 in the axial direction.

Installation/Removal Procedures

The installation of the arrangement of FIG. 4 is possible in a simple manner. In a first step, the union nut 300, which has been removed from the base body 225, is slid over the nozzle 600 for spraying concrete until the inlet-side flange 601 bears against the plate-shaped front surface 303 of the union nut. Subsequently, or at the same time, the tubular admixture piece 100 is pushed from the first end 230 into the through-flow opening 201 of the housing element 200, until the two sealing lips 110, 120 bear against the respective sealing supports 210, 220 in the base body 225. Subsequently, the union nut 300 is screwed, together with the nozzle 600 for spraying concrete, onto the outer thread 250 of the base body 225 and tightened. As the union nut 300 is screwed on, the two sealing lips 110, 120 are automatically pressed against the associated sealing supports 210, 220. The conveyance pipe or the conveyance tube 500 can be connected independently of the remaining components at any desired time.

In order to replace or remove the admixture piece 100, the union nut 300 is detached completely and removed from the base body 225. Subsequently, the admixture piece can be gripped at the flange-side end and pulled out of the through-flow opening without exertion of appreciable force.

The installation and removal procedures also work similarly with the tubular admixture piece 800 of FIG. 5.

Test Trials

In order to test the pressure resistance of the housing according to the invention, the housing element 200 (FIG. 3) made of POM-C was fitted with an admixture piece 100 (FIGS. 1-2) made of polyurethane having a Shore A hardness of approximately 90. The connection area 206 as well as the opening 302 of the union nut 300 were each closed here in a fluid-tight manner with a blank flange. Subsequently, through the connection piece 400, pressurized water was supplied and the water pressure was increased continuously. In the process, the resulting pressure resistances of the arrangement were here up to 50-60 bar before a pressure release took place as a result of expansion of the material of the union nut 300. Neither the union nut 300 nor the connection area 206 was damaged in the process, so that it was possible to run the tests repeatedly. This is advantageous particularly with a view to occupational safety, because there is no risk of the housing element or the admixture piece rupturing and being torn apart, which could result in injuries to persons.

In order to test the pressure resistance of the sealing lips 110 and 120, the bores 103 were additionally sealed off, and, in the case of one blank flange, a bore to the opening 101 was produced. Thus, at the time of the exit of water through the bore in the blank flange, a leakage of the sealing system was detected at approximately 10 bar. In other words, the sealing system is tight up to a pressure of approximately 10 bar.

In corresponding tests with the admixture piece 800 of FIG. 3, leakages even started occurring only at approximately 30 bar. Thus, this sealing system is tight even up to a pressure of approximately 30 bar.

The admixture pieces 100 (FIGS. 1-2) and 800 (FIG. 5) made of polyurethane having a Shore A hardness of 75 and 90 and the housing element 200 (FIG. 3) made of POM-C were also tested in conventional arrangements for the application of spray concrete under various conditions. As has been shown, the devices according to the invention are at least as well suited for applying spray concrete as conventional systems, but the ease of handling during cleaning and replacement of the admixture piece is significantly better.

However, the above described embodiments should only be understood as illustrative examples that can be used as desired in the context of the invention.

For example, it is possible to replace, in the case of the admixture piece 100 of FIGS. 1-2, one or both of the sealing lips 110, 120 with an O ring. In the case of the first sealing lip 110, the O ring can be arranged, for example, so it bears against the front side of the flange 105.

Similarly, it is possible to attach, in addition to the two sealing lips 110, 120, additional sealing elements, in particular additional sealing lips. Here, if necessary, conventional radial seals can also be provided. Thus, it becomes possible to further improve the sealing effect and/or to implement separate metering for adding different additives at different positions in the axial direction of the admixture piece.

It is also possible to provide, in addition to or instead of the openings 103, additional or differently designed openings, for example, slits, in the wall of the admixture piece.

In the case of the housing element 200 of FIG. 3, it is also conceivable, for example, to replace the inner cone surface 210 and/or the outer cone surface 220 with flat ring surfaces, in particular in order to simplify the manufacture of the housing.

In addition, the housing element 200 can comprise, instead of or additionally to the radial bores 213*a*, 213*b*, additional or differently designed addition openings.

The mixing section 101 of the admixture piece 100 and/or the through-flow opening 201 of the housing element 200 can also have a conically converging cross section. This can be advantageous, for example, to implement a current transformer.

Similarly, it is also possible to manufacture the admixture piece 100, the base body 225 and/or the union nut 300 partially or completely from another material than plastic, for example, from steel and/or aluminum.

Instead of the admixture piece 100, it is also possible to use the tubular admixture piece 800 from FIG. 5 in the apparatus set, the arrangement of FIG. 4, or during the installation/removal procedure.

In summary, it should be noted that a novel admixture piece and associated housing element are provided, which can be handled considerably more simply and which at the same time allow reliable sealing.

The invention claimed is:

1. Tubular admixture piece for receiving in a mixing device for controlled metering of an additive into a pumpable mixture, wherein the admixture piece has a mixing section extending through the admixture piece for conveying the pumpable mixture, and, in a wall of the admixture piece, at least one opening leading into the mixing section is provided, for the purpose of introducing the additive into the mixing section, and wherein, on the admixture piece, at least one sealing element is present for establishing an at least partially fluid-tight connection between the admixture piece and the mixing device, the at least one sealing element being designed in reference to a longitudinal axis of the tubular admixture piece as an axial seal, wherein the axial seal is designed as a ring-shaped sealing lip, wherein the axial seal is arranged on a front side of a flange formed on the admixture piece, wherein the axial seal arranged on the front side of the flange is arranged spaced at least partially away from the wall of the admixture piece, so that a groove is present between the axial seal and the wall, wherein the groove comprises a concave curved delimitation surface, wherein at least one additional sealing element is present, which is spaced in the direction of the longitudinal axis of the tubular admixture piece away from at least one sealing element, and wherein the additional sealing element is also designed as an axial seal and as a ring-shaped sealing lip, wherein the at least one additional sealing element is oriented closer to the mixing section, in a radial direction of the tubular admixture piece, than the at least one sealing element is to the mixing section, and wherein both the at least one sealing element and the at least one additional sealing element are oriented so as to point in a same direction.

2. Tubular admixture piece according to claim 1, wherein a wedge angle of the sealing lip measures 10° - 80°.

3. Admixture piece according to claim 1, wherein a maximum extent of the additional sealing element in a direction perpendicular to the longitudinal axis of the tubular admixture piece is smaller than a maximum extent of the at least one sealing element.

4. Tubular admixture piece according to claim 1, wherein at least one sealing element is connected by substance bonding to the admixture piece.

5. Tubular admixture piece according to claim 1, wherein the admixture piece, in the area of the at least one sealing element, is designed as an axial seal.

6. Tubular admixture piece according to claim 1, wherein the at least one sealing element forms an integral component of the admixture piece.

7. Tubular admixture piece according to claim 1, wherein the at least one sealing element, at least in the area of the at least one sealing element, consists of the same material as the admixture piece.

8. Tubular admixture piece according to claim 7, wherein the admixture piece is manufactured, at least in the area of the at least one sealing element, from a plastic having a Shore A hardness of 50-120.

9. Tubular admixture piece according to claim 1, wherein the admixture piece consists of a single-piece cast body and a reinforcing element embedded at least partially therein, wherein the cast body consists of a plastic.

10. Tubular admixture piece according to claim 1, wherein a first surface of the axial seal extending away from the groove extends to a free end of the sealing lip where the first surface meets a second surface of the free end of the sealing lip, and a wedge angle between the first surface and the second surface is from 10° to 80°.

11. Housing element of a mixing device for the controlled injection of an additive into a pumpable mixture, wherein the housing element comprises a base body with a through-flow opening, and the through-flow opening is designed for receiving at least partially an admixture piece according to claim 1, wherein at least one sealing support—arranged on the housing element—is present for the at least one sealing element of the admixture piece designed as an axial seal, and means are present for exerting a force acting in the axial direction and/or longitudinal direction of the through-flow opening onto the admixture piece, so that the axial seal of an admixture piece received at least partially in the through-flow opening can be pressed by the means for exerting force against the sealing support.

12. Housing element according to claim 11, wherein, as means for exerting a force onto the admixture piece, a union nut that can be screwed to the base body is present.

13. Housing element according to claim 11, wherein additionally an additional sealing support arranged in the base body is present for an additional sealing element present on the admixture piece and designed as an axial seal.

14. Housing element according to claim 13, wherein the at least one sealing support is configured as an inner cone surface and/or the additional sealing support is configured as an outer cone surface.

15. Apparatus set, comprising a tubular admixture piece and a housing element according to claim 11, wherein the admixture piece has a mixing section extending through the admixture piece for conveying the pumpable mixture, and, in a wall of the admixture piece, at least one opening leading into the mixing section is provided, for the purpose of introducing an additive into the mixing section, and wherein, on the admixture piece, at least one sealing element is present for establishing an at least partially fluid-tight connection between the admixture piece and the mixing device, the at least one sealing element being designed in reference to a longitudinal axis of the tubular admixture piece as an axial seal, wherein the axial seal is designed as a ring-shaped sealing lip, wherein the axial seal is arranged on a front side of a flange formed on the admixture piece, and wherein the axial seal arranged on the front side of the flange is arranged spaced at least partially away from the wall of the admixture piece, so that a groove is present between the axial seal and the wall, wherein the groove comprises a concave curved delimitation surface.

16. A method of metering an additive into an pumpable mixture, using a tubular admixture piece for receiving in a mixing device for controlled metering of an additive into a pumpable mixture, wherein the admixture piece has a mixing section extending through the admixture piece for conveying the pumpable mixture, and, in a wall of the admixture piece, at least one opening leading into the mixing section is provided, for the purpose of introducing the additive into the mixing section, and wherein, on the admixture piece, at least one sealing element is present for establishing an at least partially fluid-tight connection between the admixture piece and the mixing device, the at least one sealing element being designed in reference to a longitudinal axis of the tubular admixture piece as an axial seal, wherein the axial seal is designed as a ring-shaped sealing lip, wherein the axial seal is arranged on a front side of a flange formed on the admixture piece, wherein the axial seal arranged on the front side of the flange is arranged spaced at least partially away from the wall of the admixture piece, so that a groove is present between the axial seal and the wall, wherein the groove comprises a concave curved delimitation surface, wherein at least one additional sealing element is present, which is spaced in the direction of the longitudinal axis of the tubular admixture piece away from at least one sealing element, and wherein the additional sealing element is also designed as an axial seal and as a ring-shaped sealing lip, wherein the at least one additional sealing element is oriented closer to the mixing section, in a radial direction of the tubular admixture piece, than the at least one sealing element is to the mixing section, and wherein both the at least one sealing element and the at least one additional sealing element are oriented so as to point in a same direction.

* * * * *